United States Patent [19]

Yen et al.

[11] 3,982,995

[45] Sept. 28, 1976

[54] METHOD OF CONVERTING OIL SHALE INTO A FUEL

[75] Inventors: Teh Fu Yen, Altadena; Milo Don Appleman, Los Angeles; John Eugene Findley, San Gabriel, all of Calif.

[73] Assignee: The University of Southern California, Los Angeles, Calif.

[22] Filed: May 7, 1975

[21] Appl. No.: 575,448

[52] U.S. Cl. ..... 195/3 H; 166/246

[51] Int. Cl.[2] ..... C12B 1/00

[58] Field of Search ..... 195/2, 3 H; 166/246; 208/11 LE, 11 R

[56] References Cited

UNITED STATES PATENTS

| | | | |
|---|---|---|---|
| 2,641,565 | 6/1953 | Sanderson | 195/3 H |
| 2,907,389 | 10/1959 | Hitzman | 166/246 X |
| 3,032,472 | 5/1962 | Hitzman | 166/246 X |
| 3,937,520 | 2/1976 | Sievert | 166/246 X |

*Primary Examiner*—R. B. Penland

*Attorney, Agent, or Firm*—Harris, Kern, Wallen & Tinsley

[57] ABSTRACT

The invention relates to a method for converting oil shale into a fuel by contacting oil shale with a bacteria capable of producing an acid that will dissolve a portion of the inorganic lattice structure of oil shale which is thereby made porous or sponge-like in structure to expose combustible bitumen and kerogen therein.

29 Claims, 5 Drawing Figures

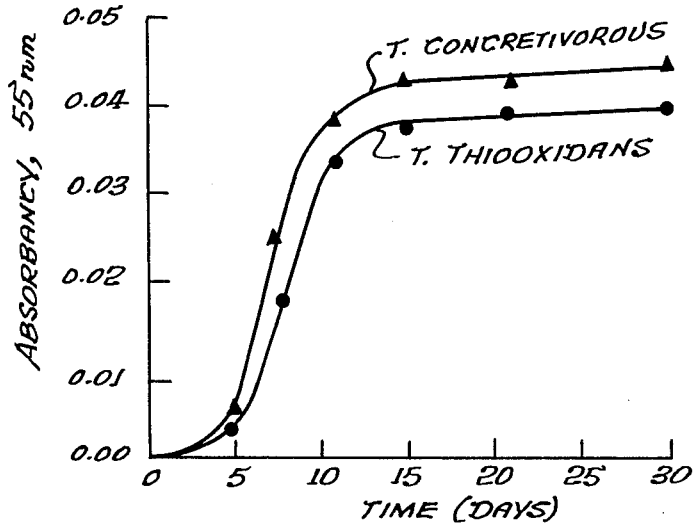

FIG. 1. GROWTH CURVE MEASURED BY INCREASE IN TURBIDITY AT 550 nm FOR STATIONARY CULTURES OF T. THIOOXIDANS AND T. CONCRETIVOROUS.

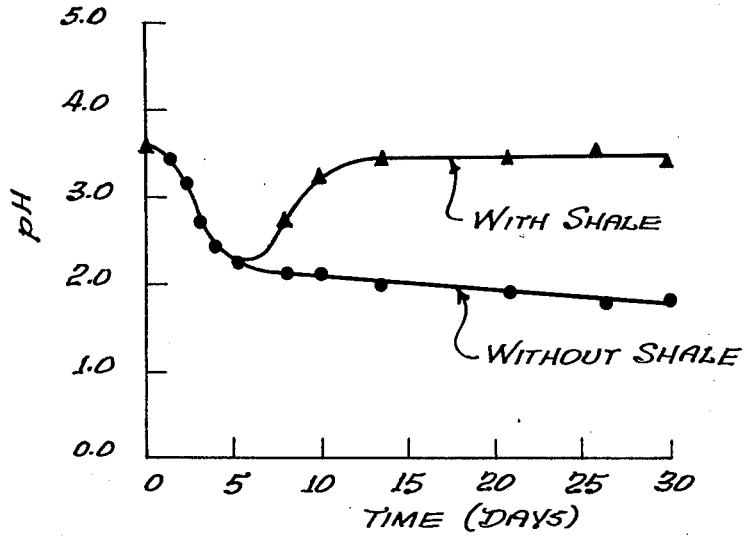

FIG. 2. CHANGE IN pH DURING GROWTH OF T. THIOOXIDANS IN INORGANIC SALT MEDIUM WITH ELEMENTAL SULFUR AS THE ENERGY SOURCE. VOLUME OF THE CULTURE WAS 1 LITER AND THE CULTURES WERE INCUBATED WITHOUT OIL SHALE. CULTURE WITH 20g PER LITER OF TYLER STANDARD SCREEN MESH SHALE (NO. 16 TO NO. 42) (▲); ●, T. THIOOXIDANS INOCULATED INTO INORGANIC SULFUR MEDIUM AT AN INITIAL pH 3.5.

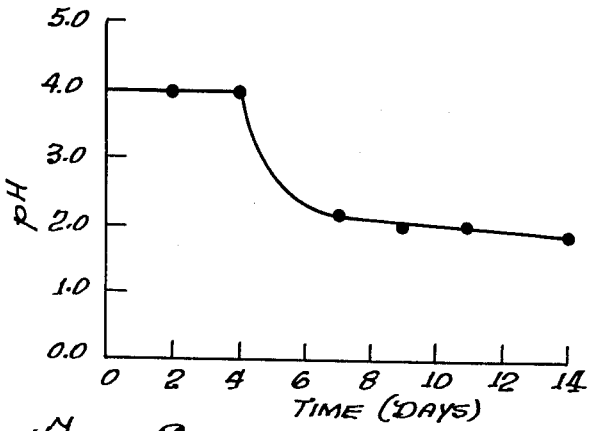
FIG. 3. CHANGE IN pH OF THE EFFLUENT FROM COLUMNS OF CRUSHED SHALE BEING LEACHED WITH T. THIOOXIDANS CULTURE.
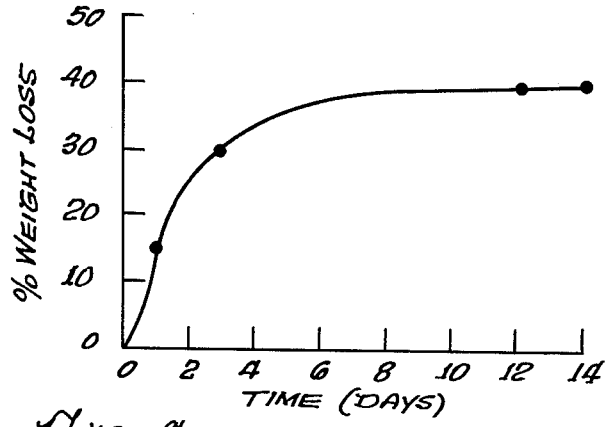
FIG. 4. PERCENTAGE OF WEIGHT LOSS OF SHALE RECOVERED AFTER LEACHING WITH T. THIOOXIDANS CULTURE SOLUTION.
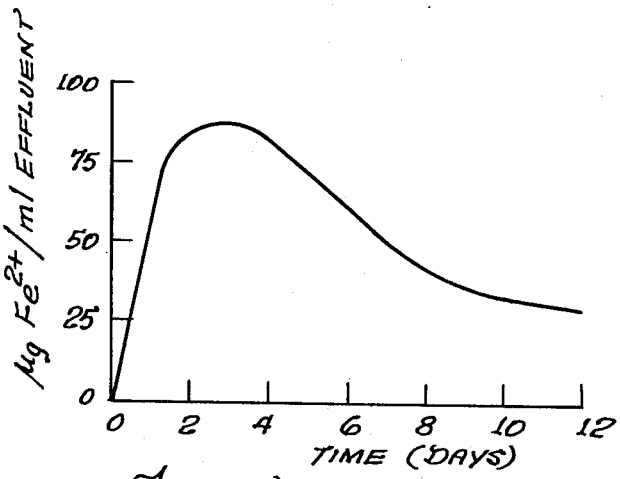
FIG. 5. $Fe^{2+}$ CONTENT OF SHALE COLUMN.

METHOD OF CONVERTING OIL SHALE INTO A FUEL

BACKGROUND OF THE INVENTION

Oil shale is generally comprised of an inorganic matrix of rock minerals and organic bitumen and kerogen trapped within the inorganic matrix. There is no oil or petroleum per se in "oil shale" which is a misnomer. Petroleum is contained in certain oil-bearing shales and may be separated therefrom by mechanical means, but such oil-bearing shales are to be distinguished from "oil-shale" as the term is used herein.

The composition of the inorganic matrix of oil shale varies widely but is generally comprised of major amounts of carbonates, such as dolomite and calcite, and silicates, such as quartz and feldspar, and minor amounts of clays, sulfurbearing pyrites and miscellaneous inorganic minerals.

The organic bitumen and kerogen in oil shale have value as a fuel and may be converted into other fuels. This organic matter is present from trace amounts to over 60% by weight with kerogen forming the major portion thereof. The major portion of these organic materials do not exist in any significant quantities outside the inorganic matrix which thereby prevents oil shale from being utilized as a fuel unless it is further processed to separate the organic materials, referred to hereinafter as "organics," from the inorganic matrix.

The most common commercial method for recovering organics from oil shale is by retorting, also referred to as pyrolysis or destructive distillation, wherein the oil shale is crushed and heated to high temperatures to break the bonds between the kerogen and the inorganic matrix and to crack the complex kerogen molecule into simpler components. By this technique about 66% of the organics are converted into a crude shale oil, about 9% are converted into a petroleum gas, and the remaining 25% is unrecovered and remains as a carbon enriched residue. A portion of the recovered organics may also be used as a source of fuel to support the pyrolysis, but if it is, it represents a loss of potentially recoverable organics.

Pyrolysis of oil shale creates an enormous problem in material handling and disposal of spent shale. For example, for every ton of shale containing 25 gallons of kerogen per ton, pyrolysis will produce approximately 200 pounds of oil, 27 pounds of retort gases, 75 pounds of carbonaceous residue, and 1700 pounds of denuded, spent shale rock. A plant designed to produce 50,000 barrels of kerogen per day would require 84,000 tons of rock shale per day and would produce approximately 70,000 tons of spent shale which would render impractical any large scale commercial operation.

Another problem with pyrolysis is that the large quantities of sulfur and nitrogen present in the organics will be converted and passed into the atmosphere as sulfur dioxide and the oxides of nitrogen which are objectionable air pollutants.

Another approach for recovering organics from oil shale is to dissolve the inorganic matrix of the oil shale in an aqueous acid solution to release the organics and recover them by flotation. This method, however, has generally been limited to laboratory research use and has not been developed as a practical commercial means for recovering organics in situ because of the danger to life and to the environment involved in handling acid, and because of the economics involved in transporting and handling acid for use in situ.

A solvent removal system is another possible approach for recovering organics from oil shale, but this is not feasible inasmuch as kerogen, which is the major component of such organics, is insoluble in organic and aqueous solvents.

It is, therefore, an object of the present invention to convert oil shale into a form in which the organic content thereof may be useable as a fuel, or may be converted into other forms of fuels such as petroleum-type oil or a synthetic natural gas, without the problems and disadvantages associated with the aforesaid methods. Other objects and advantages of the invention will become apparent as the specification proceeds.

SUMMARY OF THE INVENTION

It has been discovered that certain bacteria will grow in the presence of oil shale with the aid of a nutrient and will produce acid which will neutralize and dissolve much of the inorganic matrix of oil shale. The resultant oil shale, referred to herein as bioleached oil shale, has a porous, sponge-like structure which exposes the kerogen and bitumen and may be used as a fuel or may be further processed for conversion into other fuels, such as petroleum or a synthetic natural gas. By controlling the nutrient, the growth of such bacteria and the acid produced thereby may also be controlled. Thus a method is provided whereby the acid for leaching oil shale may be provided in situ without having to be transported, stored, and piped and whereby the amount of acid released in the environment for in situ use may be controlled to provide only as much acid as is necessary to perform its leaching function and thereafter become neutralized with a resultant safety to the environment, to equipment, and to the people working with the process.

PREFERRED EMBODIMENTS

The acid producing bacteria which are compatible with and which will grow in the presence of oil shale when provided with the proper food or nutrient are the Thiobacillus family of bacteria, hereinafter designated by the letter "T", the rumen bacteria, and *Ferrobacillus sulfooxidans* which is also known as *Thiobacillus ferrooxidans* pursuant to a change of name in this particular bacteria as listed in *Bergey's Manual of Determinative Biology*, 8th edition, 1974.

The members of the Thiobacillus family referred to herein and their type number where tested for compatibility with oil shale are set forth in Table 1.

Table 1

| Bacteria | Type No. |
|---|---|
| *T. thiooxidans* | ATCC* No. 8085 |
| *T. thioparus* | Strain 2 |
| *T. thioparus* | Strain 6 |
| *T. thioparus* | ATCC No. 8158 |
| *T. ferrooxidans* | ATCC No. 19859 |
| *T. concretivorus* | ATCC Nos. 19703 and 15494 |
| *T. intermedius* | ATCC No. 15466 |
| *T. novellus* | ATCC No. 8093 |
| *T. sulfoxidans* | |
| *T. thermitanus* | |
| *T. umbonatus* | |
| *T. lobatus* | |
| *T. crenatus* | |
| *T. neopolitans* | |

*American Type Culture Collection

**Also classified as synonyms of certain strains of *T. thiooxidans*.

The *Ferrobacillus sulfooxidans* tested for compatibility with oil shale is ATCC type number 14119. *Ferrobacillus ferroxidans* was tested for compatibility and it was found not to grow in the presence of oil shale. The rumen bacteria was obtained from the Los Angeles County Veterinarian's office. All the bacteria referred to herein above are known and readily available to the public.

The nutrients used for the rumen bacteria are carbohydrates, phosphates, and nitrogenous materials such as dextrose and sesame meal. These nutrients are metabloized by the rumen bacteria to produce formic acid, acetic acid, and propionic acid.

The nutrients used for cultures of *Thiobacillus* bacteria are elemental sulfur and pyrite ($FeS_2$) after it is converted to FeS and elemental sulfur, which may be accomplished by the *Desulfovibrio* family of bacteria, hereinafter referred to by the letter D. The members of *Desulfovibrio* family which may be used for this purpose are D. *desulfuricans* D. *vulgaris*, D. *gigas*, D. *neopolitans*, and D. *aestuari*. All of the aforesaid *Desulfovibrio* bacteria are compatible with oil shale and the resultant neutral or near neutral leaching solution from *Thiobacillus* bacteria. The *Desulfovibrio* bacteria are active only at a pH which is at or near neutral and thus are effective in providing nutrients for the *Thiobacillus* bacteria only under such conditions.

The nutrients used for the *Desulfovibrio* family of bacteria are the dead cells of *Thiobacillus*, the metabolites produced by the cells of *Thiobacillus*, the components of such cells that have been subjected to lysis and solubilization, and the sulfate resulting from neutralization of oil shale wherein the sulfate is used as an electron acceptor in the *Desulfovibrio's* metabolic processes.

The nutrients used for *Ferrobacillus sulfooxidans* are the same as for the *Thiobacillus* family of bacteria, or pyrite iron sulfates which may be produced from the neutralization of oil shale, and any nutrient that may be used for any strain of *Thiobacillus*.

EXAMPLE I

The medium

*Thiobacillus* cultures were grown on a medium containing: 2 grams of $(NH_4)_2SO_4$, 3 grams of $KH_2PO_4$, 0.5 grams of $MgSO_4.7H_20$, 0.25 grams of $CaCl_2.2H_20$ and one liter of distilled water. The medium was adjusted to a pH of 3.5 with 10 N $H_3PO_4$. Ten grams of elemental sulfur was layered on the surface of the medium which was thereafter sterilized by intermittent steaming for 30 minutes on 3 consecutive days. Autoclaving was not used since it fuses sulfur into a solid agglomerate. The sulfur provides an energy source and atmospheric $CO_2$ provides a carbon source for the growth of the cultures.

Preparation of the cultures

T. *thiooxidans*, ATCC 8085, and T. *concretivorous*, ATCC 19703, were obtained from the American Type Culture Collection. The standard inoculum was 10 ml of a 7 day culture per liter of fresh medium which was maintained at room temperature without shaking in 2.8 liter Fernbach flasks presenting a large surface-to-volume ratio. The growth curves for these microorganisms are presented in FIG. 1.

Oil shale

The oil shale used in these experiments was from the Green River formation of the Mahogany Ridge series in the State of Wyoming.

The whole-rock percentages of carbonate were determined by using a Leco gasometric analyzer. The shale samples were ground and sieved to obtain a size passed by a Tyler standard screen scale No. 16 and retained by a No. 42.

Green River oil shale consists of approximately 86% mineral and 14% organic material by weight. Mineralogically this shale is a fine-grained, varved, calcareous, sedimentary rock. Varves consist of layers of carbonates and orthoclase. Clay and organic material are intimately associated. The mineralogy of a typical Green River oil shale shows quartz ($SiO_2$) and dolomite [$CaMg(CO_3)_2$] to be the major mineral constituents. Montmorillonite is the most abundant clay mineral and accounts for about 15% of the sample weight. Pyrite is also present at approximately a 2.0% level.

The chemical characterization of kerogen from Green River shale was carried out after removal of the carbonates by solubilization with hydrochloric acid and removal of the silica and silicate with hydrofluoric acid. The kerogen molecule is a large network of hydrocarbon components with highly cross-linked structure which is largely saturated and contains some heterocyclic bridges.

Leaching experiments. In experiments involving leaching of shale by cultures, acid solution, or acid solution plus an additive, 50g of shale was placed in a cylinder (50 by 200 mm) with a stopcock on one end. The solution was allowed to percolate down through the shale at a rate of 1 liter per day. The shale was immersed continuously in the leaching solution. The pH of the cultures used for leaching was from 1.7 to 1.9. Unless otherwise indicated, the leaching experiments were carried out for 14 days. At the end of the leaching period, the shale was quantitatively recovered, washed by water, and dried for 24 hours under an infrared lamp. The change in pH during the growth of T. *thiooxidans* in the medium with and without oil shale is presented in FIG. 2.

Analytical methods

Sulfate determinations were made by adding 4 drops of 6 N HCl to a 10-ml volume of membrane-filtered sample followed by 0.5 ml of a saturated solution of barium chloride. The precipitate barium sulfate was quantitatively collected, washed and dried to constant weight.

Ferrous ion was determined spectrophotometrically after reaction with 1,10-phenanthroline.

Discussion of the results

The acid production during development of the culture resulted in a decrease in pH in the weakly buffered medium. T. *thiooxidans* inoculated into inorganic sulfur medium at an initial pH of 3.5 resulted in a decrease in pH (FIG. 2.). Inorganic sulfur medium containing 20 g of shale per liter showed the pattern of pH for the first 4 days after inoculation. The initial decrease in pH was followed by an increase as a result of buffering by carbonates released from the shale.

Shale was hydrophobic as indicated by the tendency of the ground shale particles to clump together and resist wetting. Shale was wetted by the culture fluid after the culture developed turbidity. Wetting of the shale was indicated by dispersion of shale particles as well as the precipitation of the floating sulfur. Precipitation of sulfur is known to be a result of a wetting agent phosphatidyl inositol, produced by the growing *Thiobacillus* culture.

The amount of sulfate produced in stationary T. *thiooxidans* cultures containing 20 g of shale per liter was similar to the amount of sulfate produced in cultures containing no shale, as demonstrated by the data set forth in Table 2. This indicates that the metabolism was neither inhibited nor stimulated by presence of shale at this level in this medium.

Shale recovered from stationary T. *thiooxidans* cultures incubated for 30 days was found to have lost an average of 12.4% in weight. T. *concretivorous* cultures grown under similar conditions have an average weight loss of 15.1%

The effect of the acidity on the leaching solution is shown in Table 4. The organic acids of 0.1 N acidity were less effective in solubilizing the shale sample than 0.1 N $H_2SO_4$. The total percentage of shale solubilized by sulfuric acid was not increased by increasing the acid concentration from 0.1 to 1.0 N in the volume used.

Addition of 0.01% ethylenediaminetetraacetate (EDTA) to 0.1 N sulfuric acid was not effective in increasing the weight loss of leached shale.

Table 2

Sulfate production in inorganic sulfur medium

| Organism | mg of $SO_4^{3-}$/10-ml portion on incubation days: 0 | 2 | 4 | 8 | 10 | 14 | 18 | 24 | 28 |
|---|---|---|---|---|---|---|---|---|---|
| *Thiobacillus concretivorous* | 3.4 | 10.5 | 17.5 | 25.6 | 35.7 | 39.2 | 47.3 | 47.0 | 50.2 |
| *T. thiooxidans* | 3.7 | 14.1 | 19.2 | 26.3 | 30.6 | 36.7 | 41.9 | 46.9 | 51.7 |
| *T. thiooxidans + shale* | 3.2 | 12.7 | 16.5 | 24.9 | 35.2 | 37.4 | 42.7 | 45.2 | 52.4 |
| *T. concretivorous + shale* | 3.3 | 14.2 | 16.8 | 27.2 | 36.1 | 35.9 | 44.3 | 46.1 | 52.8 |

EXAMPLE II

Example I was repeated using fourteen liters of a 42-day culture of *Thiobacillus* (pH 1.7 to 1.9), which was percolated through 50 g of oil shale at the rate of 1 liter per day. The shale was continuously submerged in leaching solution. At 42 days, the maximum concentration of acid was reached. The pH of the effluent from the leaching columns was monitored and the results are presented in FIG. 3. The pH of the effluent from the column was buffered initially at pH 4.0 by carbonates solubilized from the shale sample. Reaction of the carbonate portion of the shale was indicated by vigorous evolution of gas ($CO_2$). The rate of weight loss shown in FIG. 3 corresponded to the loss of buffering by the shale shown in FIG. 3. Evolution of visible bubbles of gas ceased at about 5 days.

Another indicator of speed of the dissolution of the shale is in the ability of acid to dissolve iron-containing minerals. The iron measured as ferrous iron was rapidly released from the shale and appeared in the effluent from the leaching column as shown in FIG. 5. The maximum peak was obtained at 2 or 3 days prior to occurance of the significant decrease in pH.

Duplicate experiments showed that shale leached with *T. thiooxidans* lost 39.30% in weight and shale leached with T. *concretivorous* lost 39.00% in weight.

The results of the carbonate determination on native shale and on bioleached shale samples are presented in Table 3. The shale sample used for the determination of carbonate carbon had lost 36.5% in weight by bioleaching. Removal of 97.0% of total carbonate was observed.

Table 3

Comparison of carbonate content of unleached shale and bioleached shale

| No. | Sample | Carbonate (%) | Corrected carbonate loss (%) |
|---|---|---|---|
| 1 | Unleached shale | 20.09a | |
| 2 | Bioleached shale | 1.35b | 95.8 |

a,4 Determinations, mean value.
b,2 Determinations, mean value.

Table 4

Observed percent weight loss of shale leached with acid or acid plus an additive*

| No. | Sample | % Wt. loss |
|---|---|---|
| 1 | 0.1 N oxalic acid | 23.34 |
| 2 | 0.1 N citric acid | 28.78 |
| 3 | 0.1 N $H_2SO_4$ | 38.45 |
| 4 | 1.0 N $H_2SO_4$ | 39.12 |
| 5 | 0.1 N $H_2SO_4$ + 0.01% EDTA | 37.92 |
| 6 | 0.1 N $H_2SO_4$ + 0.001% Triton X-100 | 38.24 |

*50 g of shale leached for 14 days: flow rate of 1 liter of culture per day.

*Thiobacillus* species are known to produce a wetting agent, phosphatidyl inositol. Shale was leached with 0.1 N sulfuric acid with 0.001% Triton X-100. There was no increase in weight loss as a result of adding a wetting agent to a 0.1 N $H_2SO_4$ leaching solution.

Shale samples were leached with T. *Thiooxidans* culture for 1, 3, 12, and 14 days. The shale was recovered, washed, dried, and weighted. The rate of weight loss is shown in FIG. 4. The maximum rate of weight loss occured during the early contact period and asymptotically decreased in rate.

In practicing the method of the instant invention, the acid producing bacteria culture may be introduced into fissures and cracks in oil shale-bearing strata, and incubated until the oil shale contacted thereby is bioleached. The bioleached area may thereupon be mined and the process repeated in areas not previously reached by the bacteria until all of the oil-shale strata is bioleached.

The oil shale may itself be mined and crushed and placed in a reactor and bioleached in a batch operation or in a continuous operation. In the batch operation, the culture of acid producing bacteria containing suitable nutrient may be introduced into the reactor before or after incubation of the bacteria. In the continuous operation, the acid producing bacteria are preferably incubated prior to bioleaching to produce acid, and then the mixture will be continuously flowed through the crushed oil shale.

While the embodiments chosen herein for purposes of the disclosure are at present considered to be preferred, it is to be understood that this invention is intended to cover all changes and modifications which fall within the spirit of scope of the invention.

We claim:

1. A method for the manufacture of bioleached oil shale from oil shale containing kerogen and bitumen bound by an inorganic matrix having a substantial acid soluble portion, the steps comprising:

a. providing an aqueous bioleaching medium comprised of a bacteria or mixture of bacteria compatible with oil shale and capable of producing an acid that will neutralize and dissolve a substantial portion of the inorganic matrix of said oil shale, and providing a nutrient to promote the growth of said bacteria;

b. incubating said bioleaching medium to promote the growth of said bacteria and thereby produce a continuous supply of acid; and c. contacting the oil shale with said incubated medium to dissolve only the acid soluble portion of the inorganic matrix and to convert said matrix into a porous sponge-like structure which exposes the kerogen and bitumen therein for combustion or for conversion into other fuels.

2. The method as set forth in claim 1 wherein deposits of oil shale are mined and crushed and immersed in a reactor containing said bioleaching medium which is incubated to produce said acid.

3. The method as set forth in claim 1 wherein deposits of oil shale are mined and crushed and placed in a reactor through which said incubated acid contraining bioleaching medium is passed.

4. The method as set forth in claim 1 wherein in situ deposits of oil shale are provided with fissures and cracks in which said bioleaching medium is introduced and incubated.

5. The method as set forth in claim 1 wherein said bioleaching medium is flowed and incubated across the surface of in situ deposits of oil shale.

6. The method as set forth in claim 1 wherein said acid producing bacteria are selected from the group consisting of:

a. rumen, b. *Ferrobacillus sulfooxidans*,(also known as *Thiobacillus ferrooxidans*) or c. The *Thiobacillus* family of bacteria.

7. The method as set forth in claim 1 wherein said acid producing bacterium is rumen which is contacted with said oil shale under anaerobic conditions, and wherein said nutrient is comprised of carbohydrates, phosphates, and nitrogenous materials which are metabolized by said bacteria to produce a mixture of organic acids comprised of formic acid, acetic acid, and propionic acid.

8. The method as set forth in claim 1 wherein said acid producing bacterium is *Ferrobacillus sulfooxidans* and said nutrient comprises the dead cells of *Thiobacillus* the metabolities produced by the cells of *Thiobacillus*, the components of *Thiobacillus* cells which have been subjected to lysis and solubilization, sulfates which may be produced from the neutralization of oil shale, pyrite iron, or any nutrient for any strain of *Thiobacillus*.

9. The method as set forth in claim 1 wherein said acid producing bacteria is a member of the *Thiobacillus* family, and said nutrient comprises sulfur in a form which can be metabolized and oxidized by said bacteria to form sulfuric acid.

10. The method as set forth in claim 9 wherein said bacterium is T. *thioxidans*.

11. The method as set forth in claim 9 wherein said bacterium is T. *concretivorous*.

12. The method as set forth in claim 9 wherein said bacterium is T. *sulfooxidans*.

13. The method as set forth in claim 9 wherein said bacterium is T. *ferrooxidans*.

14. The method as set forth in claim 9 wherein said bacterium is T. *thioparus*.

15. The method as set forth in claim 9 wherein said bacterium is T. *intermedius*.

16. The method as set forth in claim 9 wherein said bacterium is T. *novellus*.

17. The method as set forth in claim 9 wherein said bacterium is T. *thermitanus*.

18. The method as set forth in claim 9 wherein said bacterium is T. *umbonatus*.

19. The method as set forth in claim 9 wherein said bacterium is T. *lobatus*.

20. The method as set forth in claim 9 wherein said bacterium is T. *crenatus*.

21. The method as set forth in claim 9 wherein said bacterium is T. *neopolitans*.

22. The method as set forth in claim 9 wherein said nutrient is elemental sulfur.

23. The method as set forth in claim 9 wherein a pyrite bacteria and a nutrient therefore are admixed with said bioleaching medium to produce sulfur from pyrite and in a form that can be oxidized and metabolized by said *Thiobacillus* bacteria.

24. The method as set forth in claim 23 wherein said pyrite bacteria is a member of the *Desulfovibrio* family of bacteria and the nutrient for said pyritic reducing bacteria comprises the dead cells of *Thiobacillus*, the metabolites produced by *Thiobacillus*, the components of *Thiobacillus* cells which have been subjected to lysis and solubilization, or sulfates which may be produced from the neutralization of oil shale.

25. The method as set forth in claim 24 wherein said bacterium is D. *sulfuricans*.

26. The method as set forth in claim 24 wherein said bacterium is D. *vulgaris*.

27. The method as set forth in claim 24 wherein said bacterium is D. *gigas*.

28. The method as set forth in claim 24 wherein said bacterium is D. *neopolitans*.

29. The method as set forth in claim 24 wherein said bacterium is D. *aestuari*.

* * * * *

UNITED STATES PATENT AND TRADEMARK OFFICE

CERTIFICATE OF CORRECTION

PATENT NO. :3,982,995

DATED :September 28, 1976

INVENTOR(S) :Teh Fu Yen, Milo Don Appleman and John Eugene Findley

It is certified that error appears in the above-identified patent and that said Letters Patent are hereby corrected as shown below:

Column 2, line 53, in Table 1, "T.thermitanus
T.umbonatus
T.lobatus
T.crenatus"

should be --T.thermitanus**--
--T.umbonatus**--
--T.lobatus**--
--T.crenatus**--

Column 3, lines 11 and 12, "metabloized" should be --metabolized--

Column 7, line 2 "of" (1st occurance) should be --or--

Column 7, line 30, "contraining" should be --containing--

Column 7, lines 56 and 57, "Thiobacillus the" should be --Thiobacillus,the--

Column 7, line 57, "metabolities" should be --metabolites--

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*